US006935492B1

(12) United States Patent
Loeb

(10) Patent No.: US 6,935,492 B1
(45) Date of Patent: Aug. 30, 2005

(54) FLEXIBLE MIXING POUCH WITH ASEPTIC BURSTABLE INTERNAL CHAMBERS

(76) Inventor: Barry Alan Loeb, 14 Jeanette Dr., Port Washington, NY (US) 11050

( * ) Notice: Subject to any disclaimer, the term of this patent is extended or adjusted under 35 U.S.C. 154(b) by 100 days.

(21) Appl. No.: 10/342,416

(22) Filed: Jan. 14, 2003

Related U.S. Application Data

(60) Provisional application No. 60/351,895, filed on Jan. 26, 2002.

(51) Int. Cl.[7] ..... B65D 25/08
(52) U.S. Cl. ..... 206/219
(58) Field of Search ..... 206/219, 221, 206/222, 223, 541, 568; 426/85

(56) References Cited

U.S. PATENT DOCUMENTS

| | | | | |
|---|---|---|---|---|
| 2,885,104 A | | 5/1959 | Greenspan | |
| 3,156,352 A | | 11/1964 | Bayhurst | |
| 3,608,709 A | | 9/1971 | Pike | |
| 3,983,994 A | | 10/1976 | Wyslotsky | |
| 4,226,330 A | * | 10/1980 | Butler | 383/207 |
| 4,458,811 A | | 7/1984 | Wilkinson | |
| 4,519,499 A | | 5/1985 | Stone et al. | |
| 4,557,377 A | | 12/1985 | Maloney | |
| 5,353,927 A | * | 10/1994 | Stupar et al. | 206/219 |
| 5,492,219 A | * | 2/1996 | Stupar | 206/219 |
| 5,560,403 A | | 10/1996 | Balteau et al. | |
| 5,928,213 A | * | 7/1999 | Barney et al. | 604/410 |
| 6,036,004 A | | 3/2000 | Bowen | |
| 6,364,864 B1 | | 4/2002 | Mohiuddin et al. | |

* cited by examiner

*Primary Examiner*—Jacob K. Ackun, Jr.
(74) *Attorney, Agent, or Firm*—Michael I. Kroll

(57) ABSTRACT

A flexible mixing pouch with aseptic burstable internal chambers for storing a plurality of substances in isolated, hermetically sealed aseptic chambers therein in order to maintain the freshness and integrity of each pre-measured substance until ready for combining into a desired solution. The interior pocket of the outer pouch contains one or more internal storage chambers adjacent a mixing chamber. Impermeable sheets bonded to the outer pouch define the sealed storage chambers and include a frangible portion thereon forming burst ports. The user squeezes the desired storage chamber and the pressure applied thereto creates a disparity between the internal pressure against the impermeable sheet and the external pressure in said mixing chamber and compromises the integrity of the associated burst port causing it to rupture and discharge the contained substance into the mixing chamber where it is combined with the contained substance to create the desired solution having a precise, predefined ratio of the first substance to the second substance.

4 Claims, 8 Drawing Sheets

FLEXIBLE MIXING POUCH WITH ASEPTIC BURSTABLE INTERNAL CHAMBERS

This application is subject to U.S. provisional application Ser. No. 60/351,895, filed Jan. 26, 2002. Please incorporate by reference all information in said provisional application into this instant application.

BACKGROUND OF THE INVENTION

1. Field of the Invention

The present invention relates generally to mixing pouches and, more specifically, to a flexible pouch or bag which allows for the control of the amount of a component dispensed upon rupturing a burstable internal pouch and consists of one or more aseptic internal pouches for the separate storage and selective mixing of two or more components. The present invention seeks to maximize the shelf stable life of the contents by the aseptic packaging of those items usually needing refrigeration. The main pouch is hermetically, aseptically and/or vacuum sealed at its top most access portion. The seal is removed before use and provides safety, cleanliness, integrity and freshness of the components therein. A zip lock type seal is also provided for reusable qualities as well as functioning as a closure seal while mixing the internal components. The internal pouches are sealed about their peripheries to form aseptic pouches with these pouches having rupture or burstable members and are contained within a mixing pouch that may or may not store a substance. The burstable access ports also supply a penetrative access for insertion of a drinking straw or other withdrawal device. The burstable ports can be selectively placed upon the internal pouches depending on the contents of the substances to be mixed and the amount of control desired over dispensing. The drinking straw access port may be located within the interior of the main pouch or accessed from the exterior of the main pouch. The burstable member can be broken by the application of external pressure to the pouch which applies tension to the inner pouches causing a reduction in the seal strength of the member, forcing the contents of the pouch to dispense or by pulling open a sealing tab or by insertion of a withdrawal device 2. Description of the Prior Art There are other mixing devices designed for selective mixing of two or more components. Typical of these is U.S. Pat. No. 2,885,104 issued to Greenspan on May 5, 1959.

Another patent was issued to Hayhurst on Nov. 10, 1964 as U.S. Pat. No. 3,156,352. Yet another U.S. Pat. No. 3,608,709 was issued to Pike on Sep. 28, 1971 and still yet another was issued on Oct. 5, 1976 to Wyslotsky as U.S. Pat. No. 3,983,994.

Another patent was issued to Wilkinson on Jul. 10, 1984 as U.S. Pat. No. 4,458,811. Yet another U.S. Pat. No. 4,519,499 was issued to Stone et al. on May 28, 1985. Another was issued to Maloney on Dec. 10, 1985 as U.S. Pat. No. 4,557,377 and still yet another was issued on Oct. 1, 1996 to Balteau et al. as U.S. Pat. No. 5,560,403.

Another patent was issued to Bowen on Mar. 14, 2000 as U.S. Pat. No. 6,036,004. Yet another U.S. Pat. No. 6,364,864 was issued to Mohiuddin et al. on Apr. 2, 2002.

The invention relates generally to dispensing bottles and more particularly, to a novel construction for a disposable cartridge adapted to be removably installed in such a bottle, said cartridge capable of holding the solvent and solute of a predetermined solution separated one from the other until it is desired to prepare the solution and thereafter, permitting said solute to be intermixed directly in the bottle and then dispensed without removing the cartridge.

The invention relates generally to packages formed of flexible sheet materials, such as plastic, coated paper or coated foil and having a plurality of compartments separated by a seal and arranged whereby the seal can be disrupted to permit mixing of several materials, before they are dispensed from the package.

A multiple compartment laminated package is provided which is suitable for holding in separate compartments different substances which can be mixed together within the package upon breaking the barrier between the separate compartments. The barrier can be broken by the application of external pressure to the package which applies tension to the inner layer taking place at a controlled location by virtue of a reduction in the bond strength between the inner layer and the next adjoining layer of the outer wall of the package.

A flexible package or pouch including a pair of opposed sheets sealed together around their peripheral edges, forming a closed interior and sealed together along an intermediate septum line between the ends to form a pair of chambers or pockets; separate materials are contained in the respective chambers, for later mixing; tabs are provided on the sheets for grasping by the user, and in response to pulling outwardly of the tabs, the septum line of sealing is broken, establishing communication between the chambers, enabling mixing of the materials.

A compartmented and collapsible container for sterile components which has at least one separate compartment for each component, yet will permit the intermixing of the components upon the breaking of a frangible member which separates the compartments. The compartmented container is specifically constructed for use with two solutions which are normally incompatible when mixed. The container herein described permits the two incompatible solutions to be sterilized in a disposable, flexible container. At the time of usage, the two materials can be readily intermixed in the same container and administered therefrom, such as with the usual intravenous administration equipment. An important feature of the container is a frangible member which is sealed to the container in a unique manner between the compartments, yet is readily fractured to permit the free flow of materials between the compartments.

A unique container is disclosed which has at least three chambers for the separate storage and selective mixing of at least two components. The container includes two outer flexible sheets and an inner, diaphragm sheet, all sealed about their peripheries in the preferred embodiment. Multiple breakable lines of securement are formed between one of the outer sheets and the inner, diaphragm sheet. Multiple permanent lines of securement are formed between the inner diaphragm sheet and the other outer sheet, extending substantially parallel to and substantially the length of the respective breakable lines of securement. Such a container structure defines two chambers which have no common boundary and an intermediate chamber. In the preferred embodiment of the invention, the intermediate chamber does not store any substance; rather, it serves as a buffer or barrier chamber and also acts as a test for seal integrity. In another embodiment of the invention, the intermediate chamber holds a third component for mixing.

A bag suitably for mixing has a compartment, a pocket in the bag having a mouth opening so that either it can be filled with liquid to a predetermined volume or it can receive a dispensing member. The pocket is easily ruptured when the mouth is closed and, when mixing, a volume of liquid may be discharged into the compartment for mixing with a material in the compartment. During mixing the walls of the pocket abut to serve as a non-return valve in the bag. Apparatus for making the bags includes web bonding means, feeding means to feed film of waterproof thermoplastics material from rolls to the bonding means, and interrupting means to form the mouth in the pocket. The apparatus may form bags with open bottoms for insertion of the material for mixing and subsequent closure or sealed, filled bags.

A multiple chamber container for mixing and administering a plurality of products. The container has at least two chambers separated by a seal line. A frangible connector is situated between the two chambers for mixing the products contained within the chambers as desired. Each chamber has at least one port for filling of product into the chamber. The ports are located on the same exterior side of the container such that the chambers can be filled without folding the bag and by using existing filling equipment.

The invention relates to a multi-compartment bag which provides for the separation of two substances until their desired intermixing. A specific application of this multi-compartment bag is for hot or cold chemical packs. The substances in the multi-compartment bag are separated by two breakable walls and a third compartment which together act as a barrier to migration of one substance into the second substance, which would reduce the shelf life and efficiency of the hot or cold chemical pack. The present invention's use of two breakable walls and a compartment, empty or containing an inert substance, separating two reactive substances, provides a longer shelf life, a high efficiency, more reliability and improved ease of operation.

Containers and methods for making containers are disclosed. The containers include a chamber and a pouch fixed within the chamber. During manufacture, the open edges of the pouch are sealed between the walls of the container by a seal defining, in part, the peripheral edge of the chamber.

While these mixing pouches may be suitable for the purposes for which they were designed, they would not be as suitable for the purposes of the present invention, as hereinafter described. The present invention, a flexible pouch or bag which allows for the control of the amount of a component dispensed upon rupturing a burstable internal pouch and consists of aseptic internal chambers for the separate storage and selective mixing of two or more components. The main pouch is hermetically aseptically and/or vacuum-sealed at its top most access portion. The seal is removed before use and provides safety, cleanliness, integrity and freshness of the components therein. A zip lock type seal is also provided for reusable qualities as well as functioning as a closure seal while mixing the internal components. The internal chambers are aseptic sealed about their peripheries with these chambers having rupture or burstable members and are contained within a mixing pouch that may or may not store a substance. The burstable access ports also supply a penetrative access for insertion of a drinking straw or other withdrawal device. The burstable ports can be selectively placed upon the internal chambers depending on the contents and amount of the substances to be mixed. The drinking straw access port may be located within the interior of the main pouch or accessed from the exterior of the main pouch. The burstable member can be broken by the application of external pressure to the pouch which applies tension to the inner chambers causing a reduction in the seal strength of the member, forcing the contents of the chamber to dispense or by pulling a sealing tab or by insertion of a withdrawal device.

SUMMARY OF THE PRESENT INVENTION

A primary object of the present invention is to provide a mixing pouch that provides a flexible pouch or bag which allows for the control of the amount of a component dispensed upon rupturing a burstable internal pouch.

Another object of the present invention is to provide a flexible pouch that consists of aseptic, sealed internal chambers for the separate storage and selective mixing of two or more components.

Yet another object of the present invention is to provide a flexible pouch that the main pouch is sealed at its top most access portion. The seal is removed before use and provides safety, cleanliness, integrity and freshness of the components therein.

Still yet another object of the present invention is to provide a flexible pouch where a zip lock type seal is provided for reusable qualities as well as a closure while mixing the internal components.

Another object of the present invention is to provide a flexible pouch wherein the internal chambers are sealed about their peripheries with one or more chambers having rupture or burstable members and a mixing chamber that may or may not store a substance.

Yet another object of the present invention is to provide a flexible pouch that the burstable access ports supply a penetrative access for the insertion of a drinking straw or other withdrawal device.

One other object of the present invention is to provide a flexible pouch that will give the contents thereof a shelf stable nature due to the aseptic packaging of those items usually needing refrigeration.

Still yet another object of the present invention is to provide a flexible pouch that the burstable member can be broken by the application of external pressure to the pouch which applies tension to the inner chambers causing a reduction in the seal strength of the member, forcing the contents of the chamber to dispense or dispense by removal of a sealing tab.

Additional objects of the present invention will appear as the description proceeds.

The present invention overcomes the shortcomings of the prior art by providing a flexible pouch or bag which allows for the control of the amount of a component dispensed upon rupturing a burstable internal pouch and consists of aseptic, sealed internal chamber(s) for the separate storage and selective mixing of two or more components. The main pouch is sealed at its top most access portion. The seal is removed before use and provides safety, cleanliness, integrity and freshness of the components therein. A zip lock type seal is also provided for reusable qualities as well as for a closure while mixing the internal components. The internal chambers are sealed about their peripheries to provide aseptic chamber(s) having rupture or burstable members and a mixing chamber that may or may not store a substance. The burstable access ports also supply a penetrative access for insertion of a drinking straw or other withdrawal device. The burstable ports can be selectively placed upon the internal chambers depending on the need for control over the amounts of the substances to be mixed. The drinking straw or withdrawal device access port may be located within the interior of the main pouch or accessed from the exterior of the main pouch. The burstable member can be broken by the application of external pressure to the pouch which applies tension to the inner chambers causing a reduction in the seal strength of the member, forcing the contents of the chamber to dispense or by pulling a tab or by insertion of a withdrawal device.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
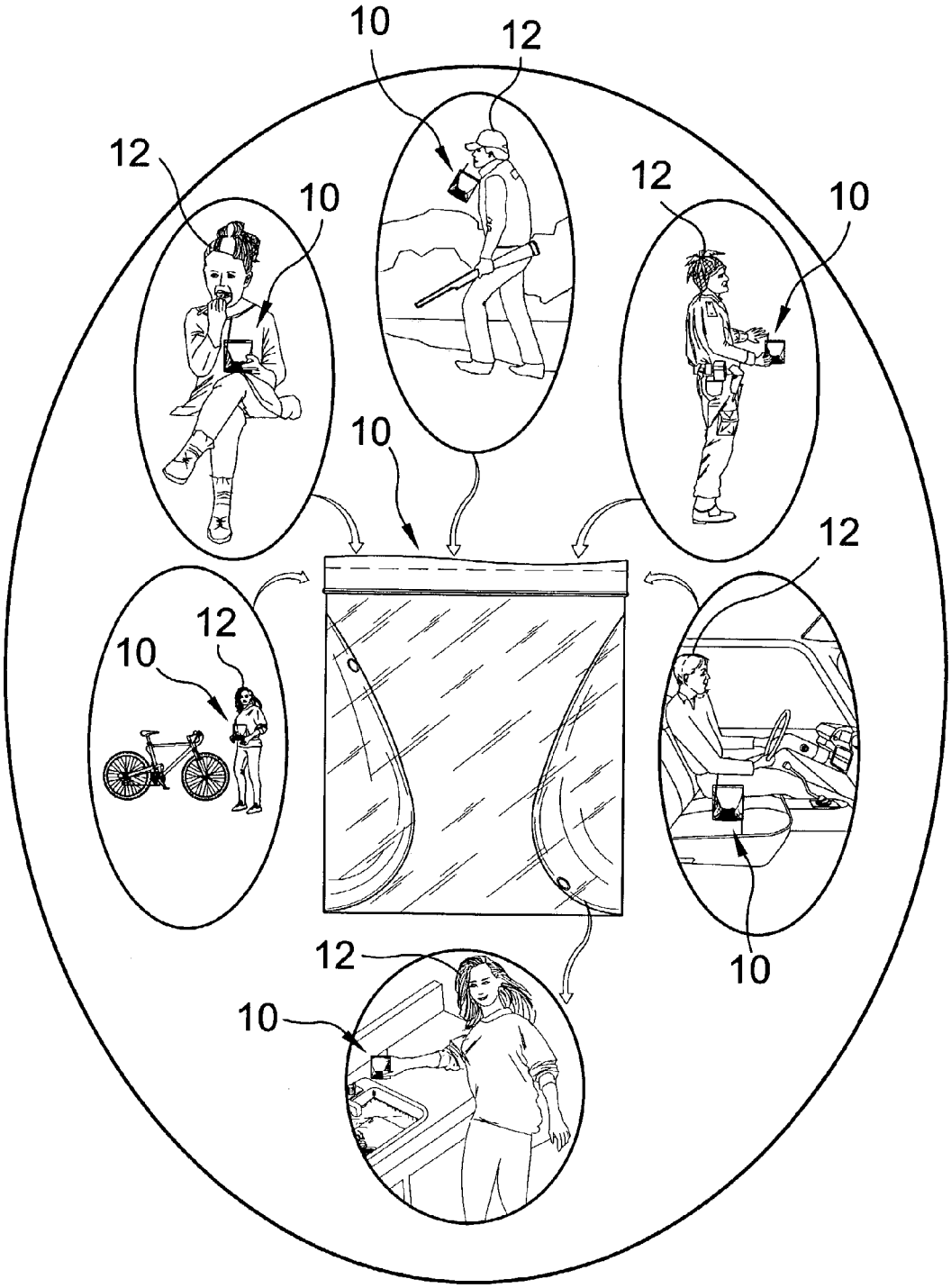
FIG. 1 is an illustrative view of the present invention in use.

Turning now descriptively to the drawings, in which similar reference characters denote similar elements throughout the several views, the figures illustrate the Flexible Mixing Pouch with Aseptic Burstable Internal Chamber of the present invention. With regard to the reference numerals used, the following numbering is used throughout the various drawing figures.

10 Flexible Mixing Pouch with Aseptic Burstable Internal Chamber of the present invention

12 user

14 flexible outer pouch

16 interior pocket

18 non-permeable sheet

20 first internal storage chamber

22 second internal storage chamber

24 third internal storage chamber

26 mixing chamber

28 burst port

29 interior pocket access means

30 integrity seal

32 resealable interlocking seal

34 straw access burst port

36 first contained substance

38 second contained substance

40 third contained substance

42 drinking straw or withdrawal device

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is a flexible outer pouch 14 or bag which allows for the control of the amount of a component dispensed upon rupturing a burstable internal storage pouch 20, 22, 24 and consists of aseptic internal chamber(s) for the separate storage and selective mixing of two or more components in a mixing chamber 26. The outer pouch 14 may be aseptically, hermetically, sealed and/or vacuum sealed at its top most access portion. This tear-off seal forms an integrity seal 30 that is removed to provide an access means 29 to the interior pocket 16 and provides safety, cleanliness, integrity and freshness of the components within. A resealable interlocking seal 32 is also provided for reusable qualities as well as for a closure seal while mixing the internal components. The internal chambers 20, 22, 24 are sealed about their peripheries to provide aseptic chambers having frangible portions defining burst ports 28. The outer pouch 14 mixing chamber 26 may or may not store a substance.

Figure 2:
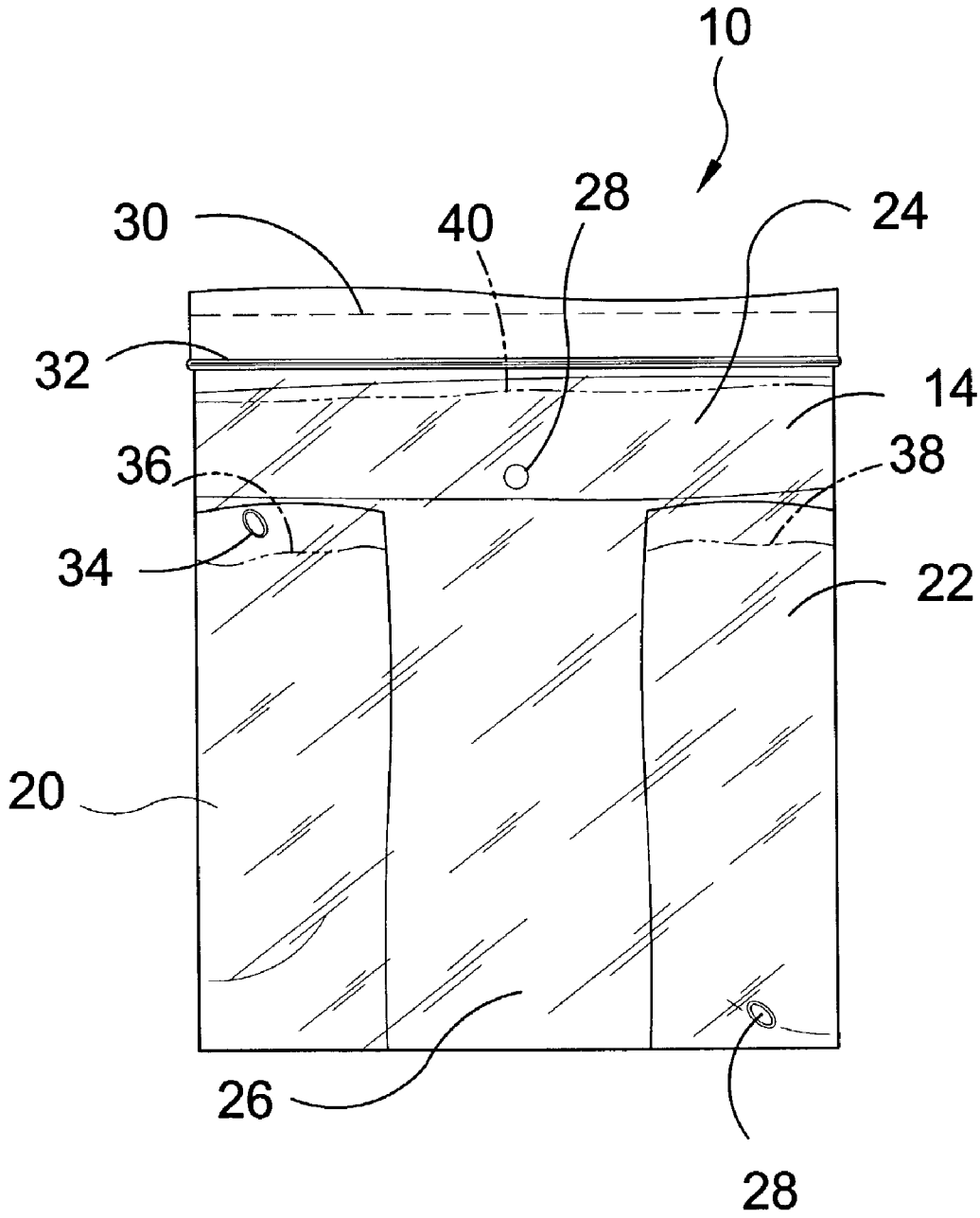
FIG. 2 is a front view of the present invention.

FIG. 2 is a front view of the present invention 10. Shown is the present invention 10 wherein the interior pocket 20 contains a first contained substance 36 sealed within a first internal storage chamber 20, a second contained substance 38 sealed within a second internal storage chamber 22, a third contained substance 40 sealed within a third internal storage chamber 24 and a mixing chamber 26 without a contained substance but into which one may be placed if desired during manufacturing or by the user once the interior pocket access means 29 has been opened. The first internal storage compartment 20 includes straw access burst port 34 on the top portion thereof to provide for the insertion of a drinking straw 42 therein.

Figure 3:
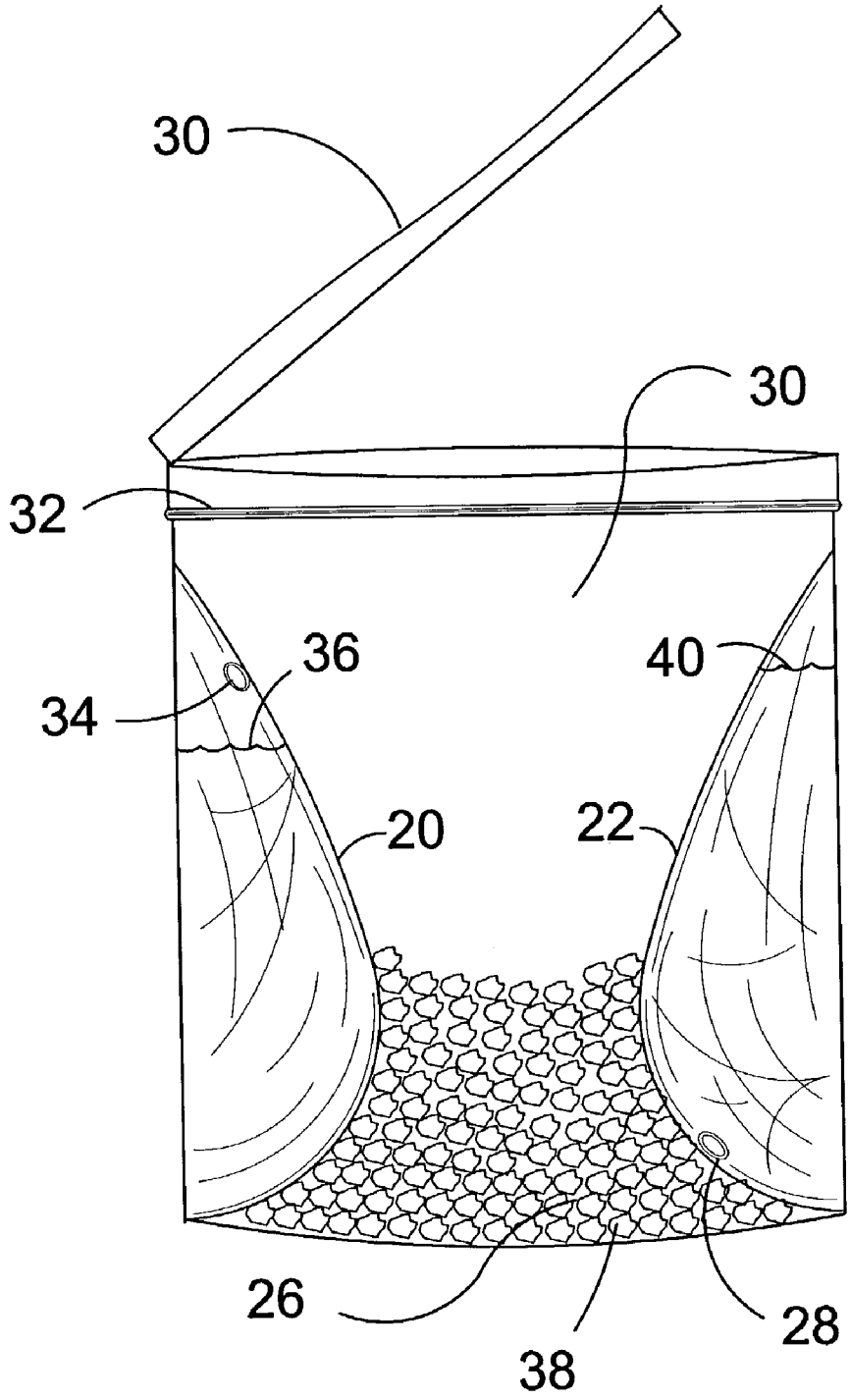
FIG. 3 is a front view of the present invention.

FIG. 3 is a front view of the present invention 10 having a first contained substance 36 sealed within the first internal storage chamber 20, a second contained substance 38 sealed within the mixing chamber 26 and a third contained substance 40 sealed within the second internal storage chamber 22.

Figure 4:
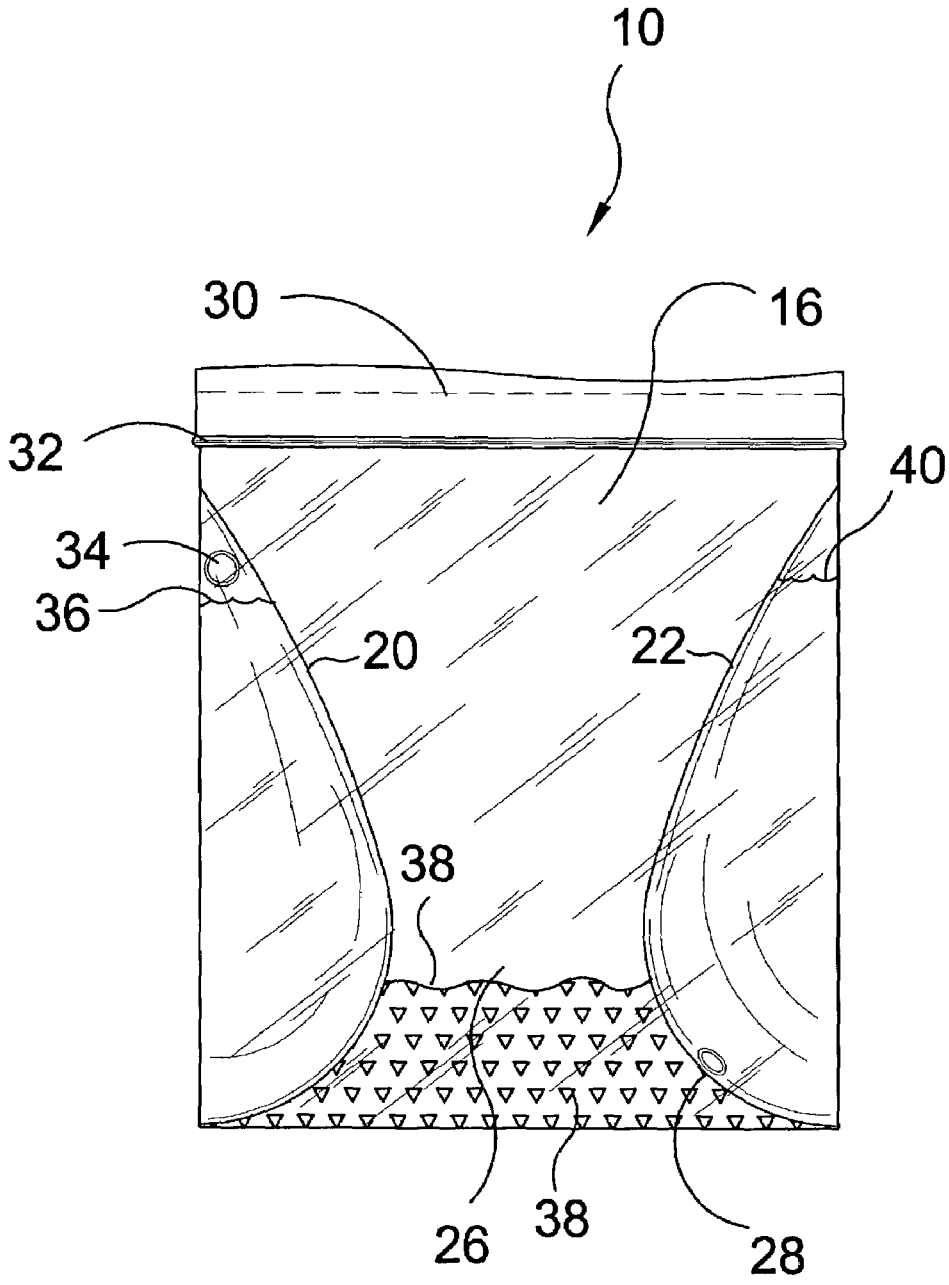
FIG. 4 is a front view of the present invention.

FIG. 4 is a front view of the present invention 10. Shown is a view of the present invention 10, a flexible pouch 14 which allows for the control of the amount of a component dispersed upon rupturing a burstable internal pouch and consisting of two aseptic sealed internal chambers for the separate storage of perishable components and a mixing chamber 26 which contains a substance and allows selective mixing of two or more components in the mixing chamber 26. The first internal chamber includes an external straw access burst port 34 located at its uppermost portion and may be accessed by a drinking straw for drinking the first contained substance 36 within. The second internal chamber includes a burst port 28 at its center portion for the controlled release of the third contained substance 40 into the mixing chamber 36. When the first contained substance 36 and/or the third contained substance 40 are released into the mixing chamber 26, they blend with the second contained substance 38 to form the desired solution.

Figure 5:
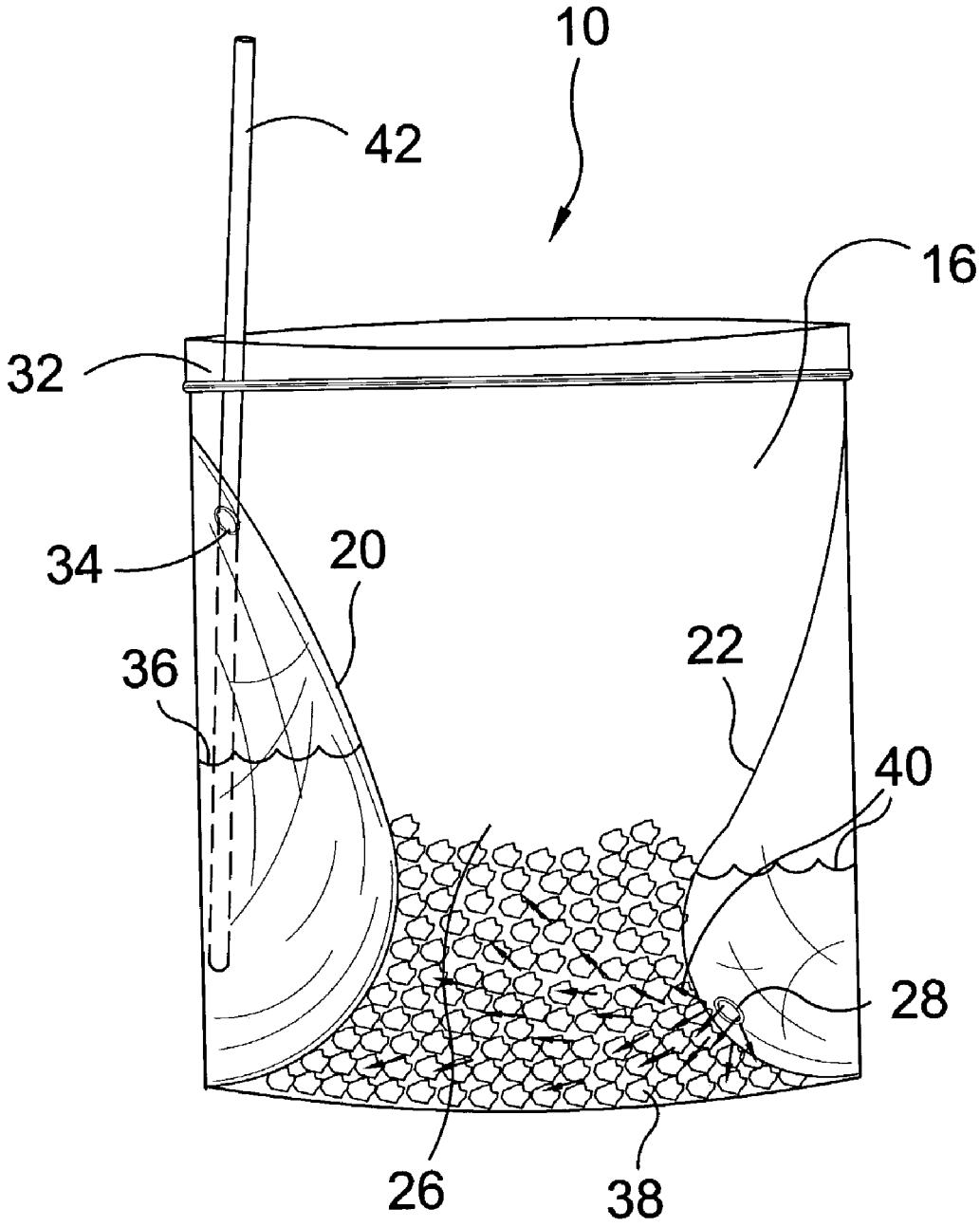
FIG. 5 is a front view of the present invention.

FIG. 5 is a front view of the present invention 10 wherein a drinking straw 42 has pierced the straw access burst port 34 for insertion therein and some of the first contained substance 36 has been removed therefrom. External pressure has been applied to the second internal storage chamber 22 thereby rupturing the burst port 28 and transferring the third contained substance 40 into the mixing chamber 26 where it combines with the second contained substance 38 resulting in the desired solution.

Figure 6:
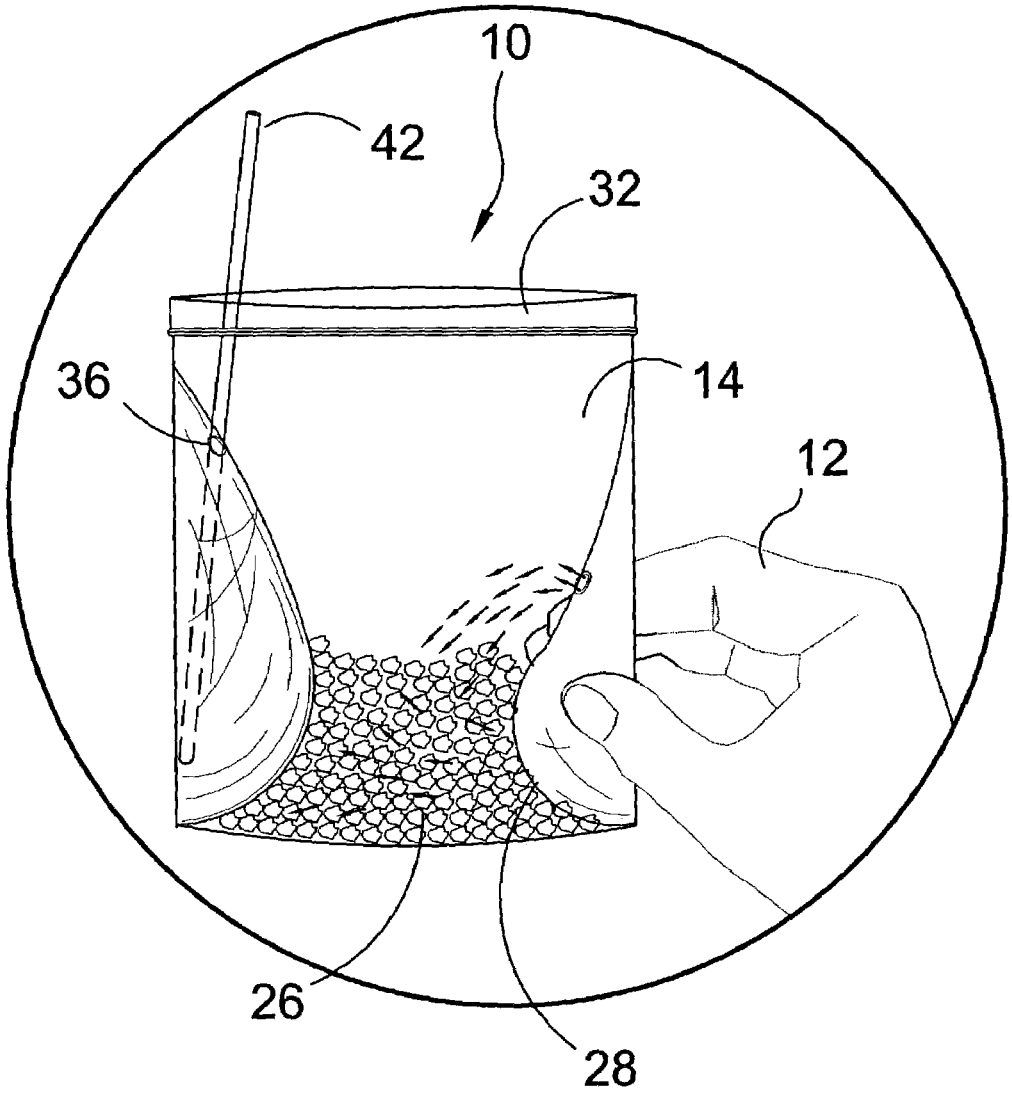
FIG. 6 is a front view of the present invention.
Figure 7:
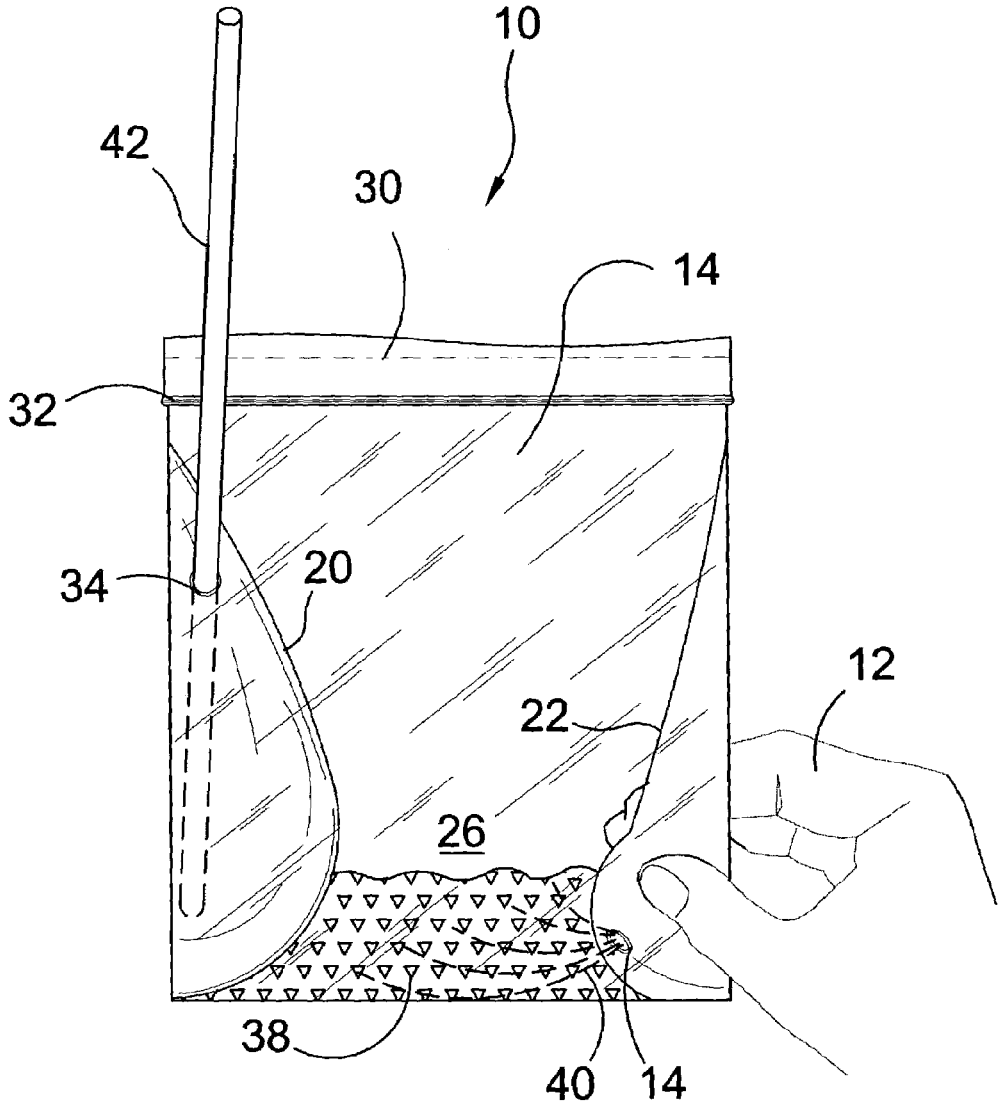
FIG. 7 is a front view of the present invention.

FIG. 6 is a front view of the present invention 10 demonstrating that the positioning of the burst port 28 and the straw access burst port 34 may be distributed as needed FIG. 7 is a front view of the present invention 10 showing the user 12 squeezing the second internal storage chamber 22 thereby ejecting the third contained substance 40 into the mixing chamber 26 where it combines with the second contained substance 38 to create the desired solution.

Figure 8:
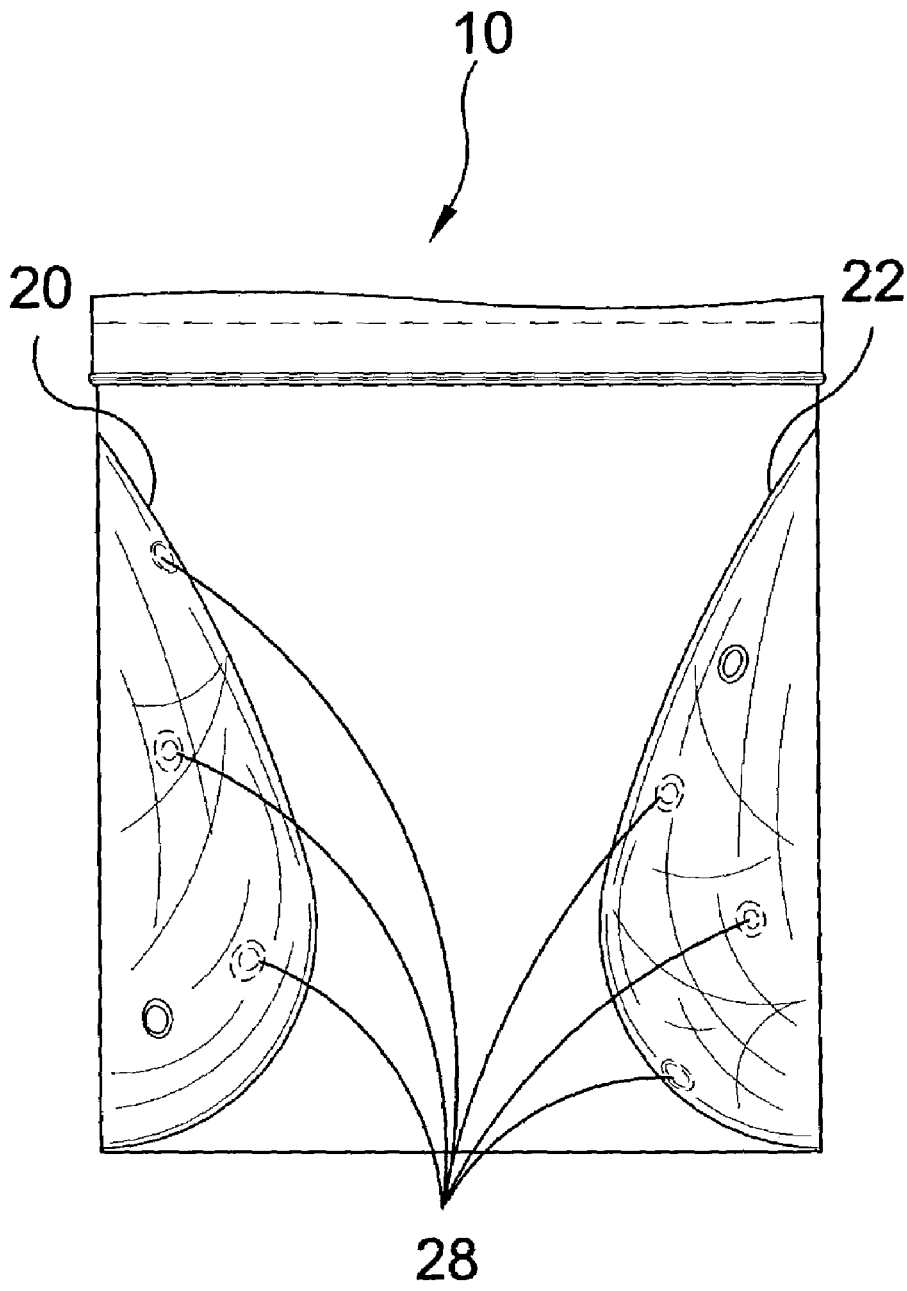
FIG. 8 is a front view of the present invention.

FIG. 8 is a front view of the present invention 10 demonstrating that the placement of the burst ports 28 can be positioned anywhere on the impermeable sheet 18 as dictated by the intended application.

What is claimed is:

1. A mixing pouch for storing and blending a plurality of substances comprising:

a) a flexible, non-permeable outer pouch rectangular in configuration forming a hermetically sealed interior pocket;

b) a non-permeable sheet peripherally bonded to said outer pouch within said interior pocket forming a first hermetically sealed, aseptic interior storage chamber therein adjacent a first side edge of said outer pouch and another non-permeable sheet peripherally bonded to said outer pouch within said interior pocket forming a second hermetically sealed, aseptic interior storage chamber adjacent an opposite second side edge of said outer pouch, with a mixing chamber formed in said outer pouch between said first and second interior storage chambers;

c) at least one frangible portion on each said non-permeable sheet forming a burst port that will rupture when the internal pressure of said interior storage chamber exceeds a predetermined PSI to expel any contents therein into said mixing chamber;

d) at least two substances sealed within said interior pocket with each substance isolated in its own aseptically sealed storage chamber; and e) said outer pouch having a means for accessing said interior pocket comprising an integrity seal comprising a tear-away strip near a top edge of said outer pouch and a slidably interlocking seal along the top edge of said outer pouch between said tear-away strip and said mixing chamber thereby allowing a user to selectively open and reseal said outer pouch.

2. A mixing pouch for storing and blending a plurality of substances as recited in claim 1, wherein a second substance is factory-sealed within said mixing chamber.

3. A mixing pouch for storing and blending a plurality of substances as recited in claim 2, wherein the burst port in said first storage chamber is located on a lower portion of the respective impermeable sheet and the burst port in said second storage chamber is located in an upper portion of the respective impermeable sheet to allow access, for a straw extending out through the resealable interlocking seal.

4. A mixing pouch for storing and blending a plurality of substances as recited in claim 3, farther including a third solid substance is sealed within said mixing chamber thereby permitting a user to selectively combine said solid substance in said mixing chamber with the substance from said first internal storage chamber.

* * * * *